United States Patent [19]

Kendall

[11] 4,021,968

[45] May 10, 1977

[54] COUNTERBALANCING HINGE FOR RANGE OVEN DOORS OR THE LIKE

[76] Inventor: Willard E. Kendall, 1034 Bayside Road, Willow Lake Estates, Elgin, Ill. 60120

[22] Filed: May 14, 1976

[21] Appl. No.: 686,481

[52] U.S. Cl. ..... 49/386; 126/191; 126/194

[51] Int. Cl.[2] ..... E05F 1/10

[58] Field of Search ..... 49/386; 126/191, 194; 16/69, 79, 145, 146; 312/319; 403/4, 16, 84, 104, 109, 112, 61

[56] References Cited

UNITED STATES PATENTS

| | | | |
|---|---|---|---|
| 1,759,474 | 5/1930 | Volquardsen | 16/79 |
| 1,950,041 | 3/1934 | Torchin et al. | 151/37 |
| 1,976,077 | 10/1934 | Lindberg et al. | 151/37 |
| 2,213,471 | 9/1940 | Minnick | 403/61 |
| 2,763,342 | 9/1956 | French | 403/109 |
| 2,833,270 | 5/1958 | Brown et al. | 126/191 |
| 2,833,326 | 5/1958 | Knohl | 151/37 |
| 3,144,863 | 8/1964 | Pollock | 126/191 |
| 3,389,734 | 6/1968 | Gutshall | 151/37 |
| 3,605,845 | 9/1971 | Junker | 151/37 |
| 3,749,080 | 7/1973 | Kleinhenn | 126/194 |
| 3,842,542 | 10/1974 | White et al. | 126/194 |

*Primary Examiner*—Peter M. Caun
*Attorney, Agent, or Firm*—Hill, Gross, Simpson, Van Santen, Steadman, Chiara & Simpson

[57] ABSTRACT

A counterbalancing hinge for range oven doors or the like includes the following features: (a) articulated members one of which is a bracket adapted to be secured to a supporting body structure such as a range and the other of which is an arm adapted to be received within an oven door or the like and carrying a counterbalancing spring, (b) means for selectively adjusting the counterbalancing spring, (c) door leveling means, (d) an arm latching and locking device activated when the door is removed from the arm, (e) a strain separable detent carried by the spring supporting arm to restrain the arm selectively in door-partially open position, (f) counterbalancing spring action controlling mechanism, (g) spring for retaining the door so it can be removed only when in partially open position, (h) only a screwdriver is needed for installing or removing the counterbalancing hinge relative to the installation, (i) only a screwdriver is needed to, adjust, remove or replace the counterbalancing spring.

35 Claims, 19 Drawing Figures

COUNTERBALANCING HINGE FOR RANGE OVEN DOORS OR THE LIKE

This invention relates to the art of hinges and is more particularly concerned with new and improved counterbalancing hinges constructed and arranged as self-contained assemblies facilitating ease of installation and operation in range oven doors and the like.

Numerous and varied hinge structures for oven doors or the like and counterbalancing devices are known. Most such devices require complicated assembly procedures and are difficult to service or adjust after installation in oven ranges or the like at the factory. Representative of prior patents along this line is U.S. Pat. No. 2,835,244.

More recently, oven door hinges have been disclosed, as in U.S. Pat. No. 3,503,380 for example, wherein a bracket portion is secured inside the range body and an arm hinged to the bracket is received within the oven door from which the oven door may be lifted off in the so called broil or partially open position. One of the major problems with the arrangement according to that patent is that the counterbalancing spring is carried by the mounting bracket inside the range frame and subject to the deteriorating effects of oven heat. Another disadvantage of the identified patent structure is that the spring cannot be adjusted, so that the spring at one side of the door may vary in its biasing effect relative to the other and one spring may be overloaded and eventually fail, in addition to uneven working of the door induced by the uneven spring action. Another disadvantage is that the counterbalancing spring cannot be readily replaced by the manufacturing installer or in the field by a serviceman.

An important object of the present invention is to overcome the deficiencies, inefficiencies, disadvantages, shortcomings and problems encountered in prior structures of the class to which the present invention is directed and to provide a new and improved counterbalancing hinge assembly for range oven doors or the like.

Another object of the invention is to provide a new and improved counterbalancing hinge assembly, for range oven doors or the like, of the self-contained unitary type wherein the counterbalancing spring is carried by an arm of the device adapted to be associated within the oven door or the like.

Another object of the invention is to provide a new and improved range counterbalancing hinge assembly for oven doors or the like, wherein the counterbalancing spring can be readily adjusted for uniform coaction with the counterbalancing spring of a companion hinge assembly.

A further object of the invention is to provide a new and improved counterbalancing hinge assembly for range oven doors or the like having novel means for selectively maintaining an associated door closed or partially open.

Still another object of the invention is to provide a new and improved range counterbalancing hinge assembly for oven doors or the like having a unique spring action modifying mechanism.

According to features of the invention, there is provided a counterbalancing hinge assembly for range oven doors or the like, adapted to mount a door in closing relation to an opening in a body structure and from which the door must be capable of swinging to an open position about an axis along the bottom of the opening, the assembly comprising articulated members including a supporting bracket adapted to be secured to the body structure adjacent to one side of the bottom edge of the opening and an arm adapted to be received within the door, means pivotally connecting the arm to the bracket for movement of the arm between a generally upright closed door position and a generally horizontal open door position, a counterbalancing spring carried by the arm, and means coupling the spring to the bracket and operative in the upright position to effect spring bias of the arm toward the closed door position, and operative to cause the spring to counterbalance the door when the arm is moving with the door toward and away from the door open position.

Additional features of the invention include means for adjusting the counterbalancing spring of a counterbalancing hinge assembly for range oven doors or the like, of the self-contained type; convenient door leveling means in a counterbalancing hinge assembly of the self-contained type; improved latching means for holding the door mounting arm against displacement from partially door open position when the door is removed from the arm; new and improved strain separable detent means selectively operable to hold the door mounted on the hinge assembly in a partially open position; and new and improved counterbalancing spring action controlling mechanism; spring for retaining the door so it can be removed only when in partially open position; only a screwdriver is needed for installing or removing the counterbalancing hinge relative to the installation; only a screwdriver is needed to, adjust, remove or replace the counterbalancing spring.

Other objects, features and advantages of the invention will be readily apparent from the following description of certain representative embodiments thereof, taken in conjunction with the accompanying drawings although variations and modifications may be effected without departing from the spirit and scope of the novel concepts embodied in the disclosure, and in which.

Figure 1:
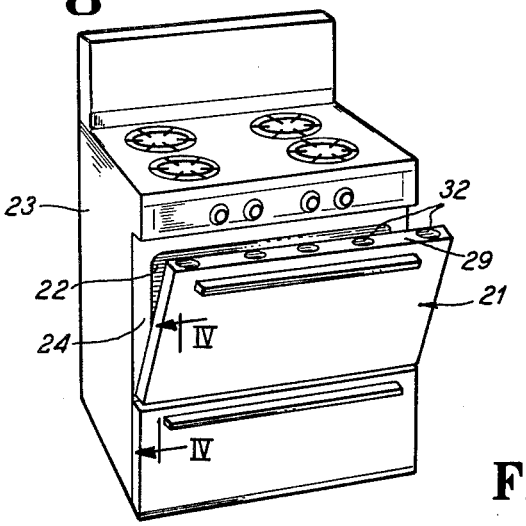
FIG. 1 is a perspective view of a representative cooking range having an oven door which may be equipped with counterbalancing hinge assemblies according to the present invention.
Figure 4:
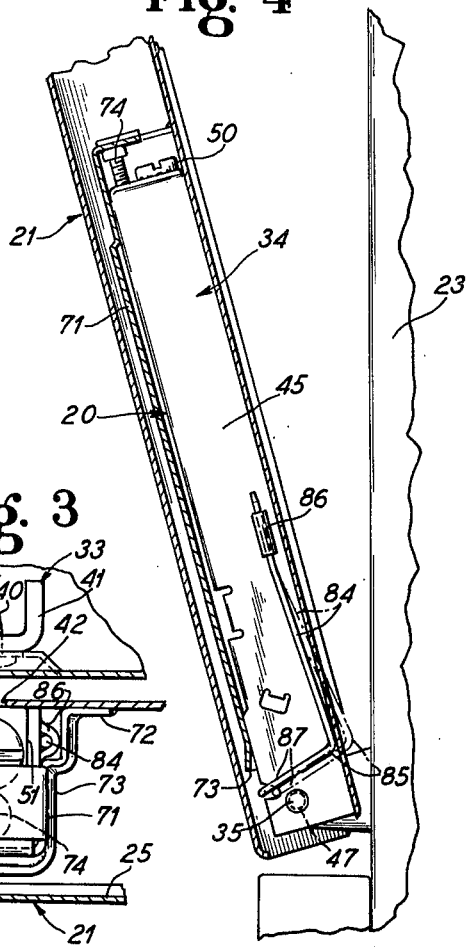
FIG. 4 is an enlarged fragmentary sectional elevational detail view taken along the line IV—IV of FIG. 1.
Figure 3:
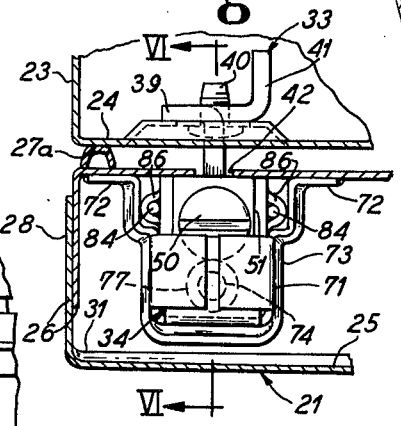
FIG. 3 is an enlarged fragmentary horizontal sectional detail view taken substantially along the line III—III of FIG. 2.
Figure 2:
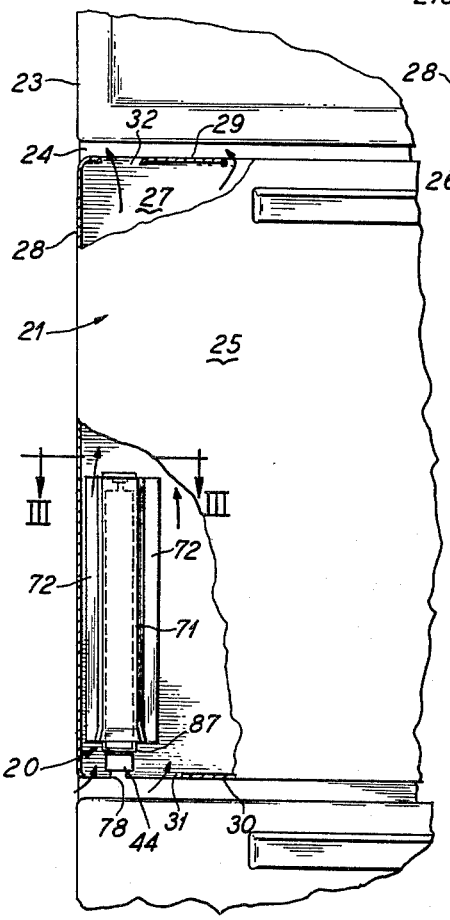
FIG. 2 is an enlarged fragmentary elevational view of the front of the range showing a hinge assembly according to the present invention installed therewith and the face panel of the door partially broken away for illustrative purposes.
Figure 5:
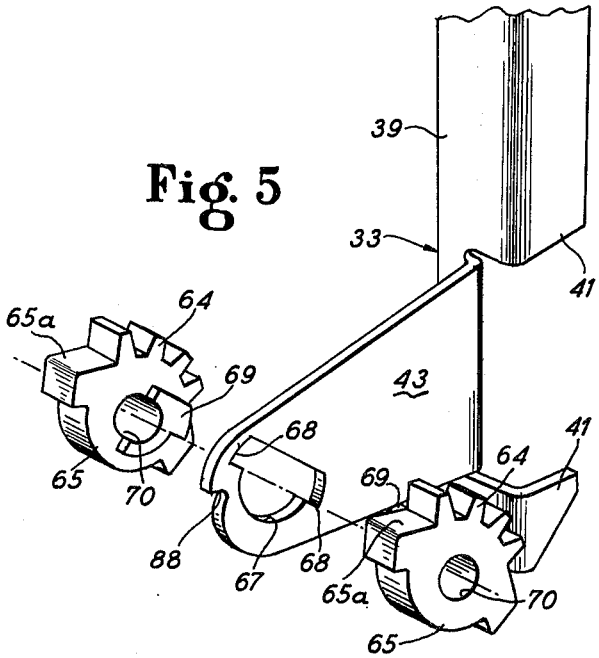
FIG. 5 is a fragmentary exploded assembly view showing that part of the counterbalancing spring coupling mechanism which is carried by the range or body structure mounted bracket.

On reference to FIGS. 1–4, a preferred form of spring assembly 20 embodying the invention is constructed and arranged to mount an oven or like door 21 in closing relation to an opening 22 in a body 23 which, as shown, is of a representative domestic range type, but may comprise a commercial range or any other apparatus having a drop door. About the opening 22, the range wall or the like provides a door or seating area frame 24. The door 21 may be of the hollow type comprising a front or outer panel 25 and an inner panel or liner 27 which has a sealing bead 27*a*. The door panels have joined angular marginal flanges 26 providing side edges 28, a top edge 29 and a bottom edge 30. Although the hollow space within the door may be filled with insulating material, a desirable arrangement provides for cooling air circulation through the door, the lower edge 30 being provided with suitable air inlet holes 31, and the upper edge 29 being provided with suitable air exit holes 32. To support the door 21 for swinging about an axis along the bottom of the opening 22 between fully closed position and fully open position, two of the hinge assemblies 20 are employed, one being located adjacent to one side of the door and the other being located adjacent to the opposite side of the door.

Figure 7:
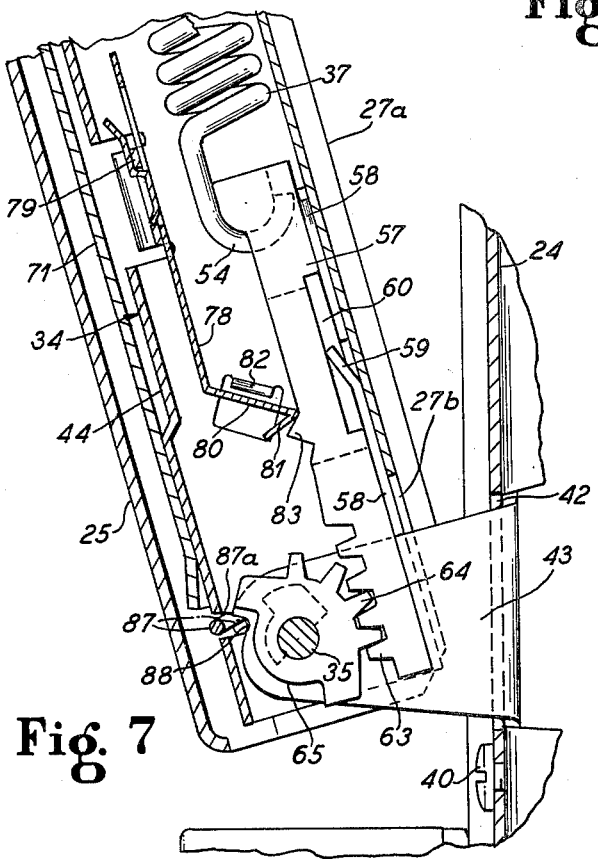
FIG. 7 is a view similar to FIG. 6 but showing the door and hinge in the partially open position.
Figure 8:
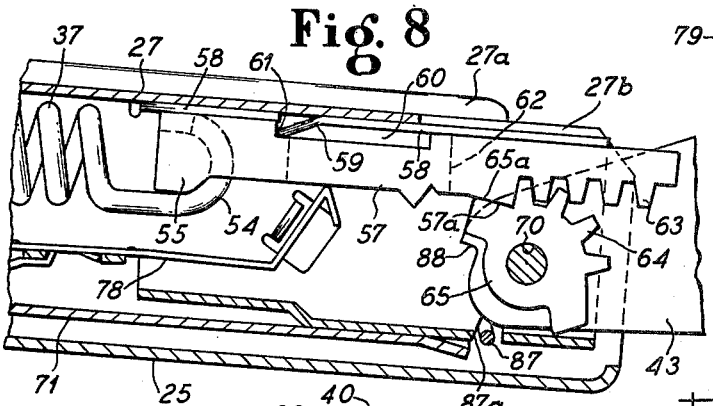
FIG. 8 is a similar view showing the door and associated hinge in the fully open position.
Figure 9:
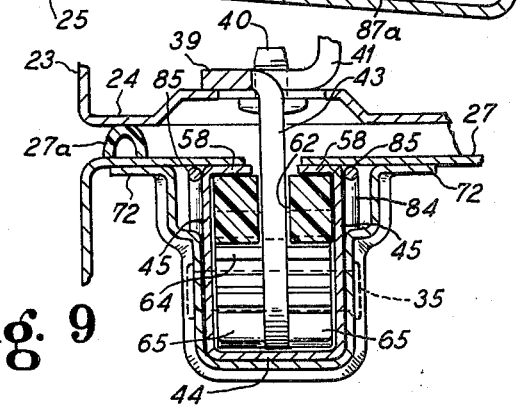
FIG. 9 is a fragmentary horizontal sectional detail view taken substantially along the line IX—IX of FIG. 6.
Figure 6:
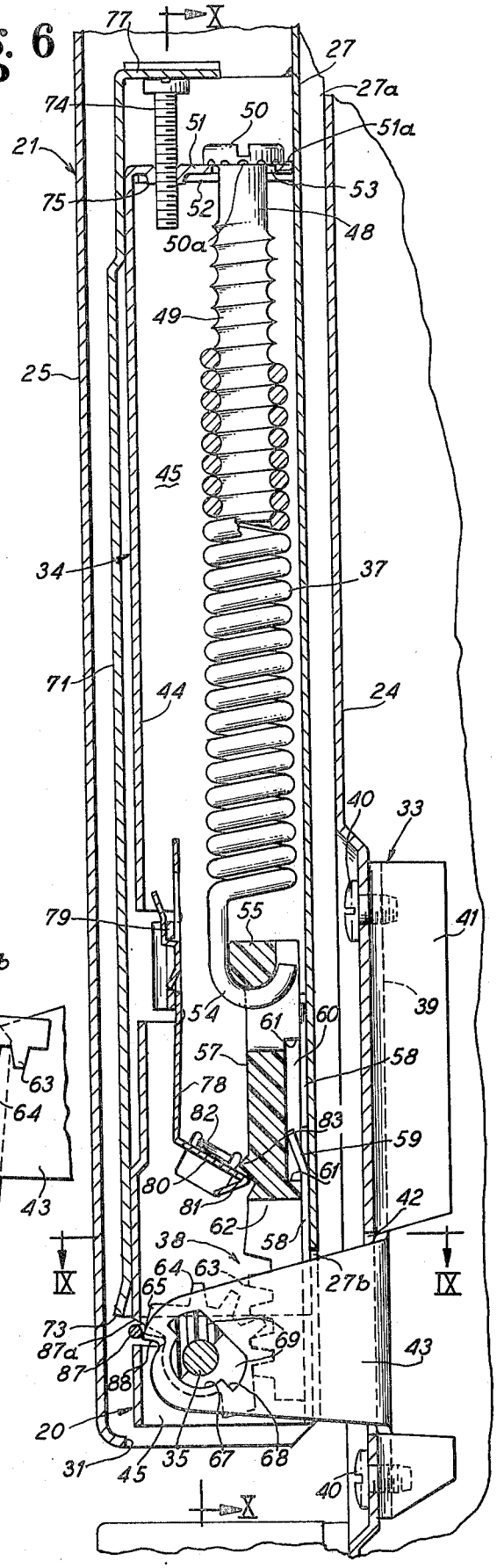
FIG. 6 is an enlarged fragmentary vertical sectional detail view taken substantially along the line VI—VI of FIG. 3.
Figure 10:
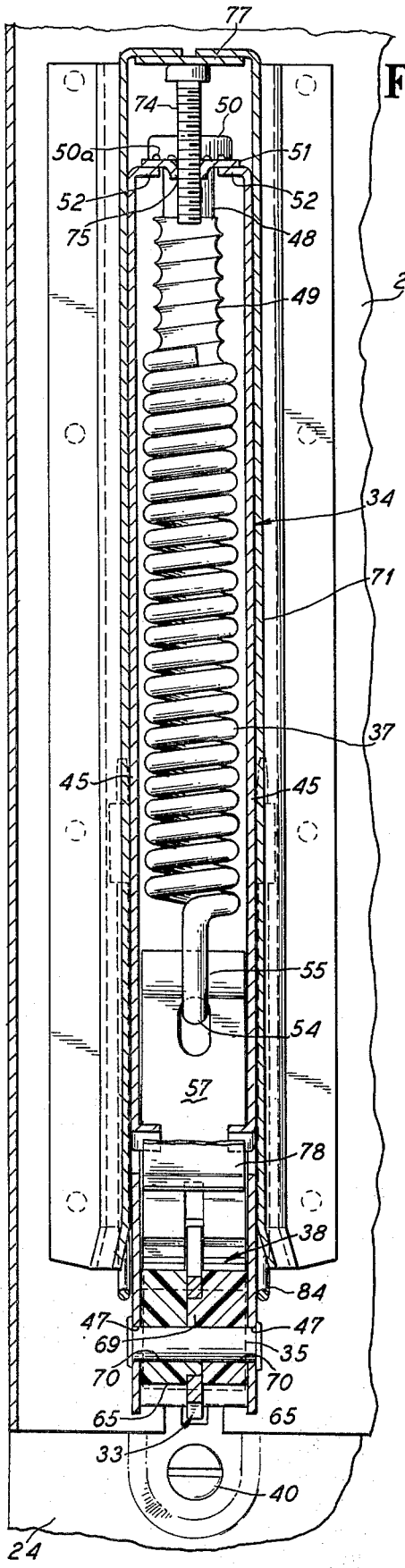
FIG. 10 is a vertical sectional elevational detail view taken substantially along the line X—X of FIG. 6.

In a representative construction of the hinge assembly 20 as shown in FIGS. 1–10, articulated members including a supporting bracket 33 adapted to be secured to the range 23 or the like adjacent to one side of the bottom edge of the opening 22 and an arm 34 adapted to be received within the range oven door 21 or the like are pivotally connected together by means of a shaft or pin 35 such as a rivet for movement of the arm 34 between a generally upright closed door position as shown in FIG. 6 and a generally horizontal open door position as shown in FIG. 8. A counterbalancing spring 37 is carried by the arm 34. Coupling means 38 connect the spring 37 to the bracket 33 and are operative in the upright position of the arm 34 to effect spring bias of the arm toward the closed door position of FIG. 6, and operative to cause the spring to counterbalance the door when the arm 34 is moved with the door 21 toward and away from the door open position of FIG. 8.

In a preferred form, the bracket 33 is formed up from heavy gauge sheet metal such as by suitable die stamping technique and comprises a vertically extending body portion 39 adapted to be secured at a suitable location at the inner side of the frame 24 by means of fasteners 40 such as self threading screws adjacent to its upper and lower ends. Angular reinforcing flange means 41 may be provided along each side of the body 39. Extending outwardly a desirable distance through a suitable slot 42 in the frame 24 is a bracket arm 43 which extends angularly from the bracket body 39.

In a preferred construction, the hinge arm 34 is formed up from suitable sheet metal into a hollow, elongated tubular structure having a front wall 44 and opposite spaced side walls 45 (FIG. 9) providing a generally channel shaped rearwardly open hollow shell. At their lower ends at least, the side walls 45 are spaced apart sufficiently to accommodate the coupling mechanism 38, and are provided with suitable aligned connecting pin or axle holes 47 (FIG. 4) to receive the shank of the pivot pin 35 therethrough. Desirably, the counterbalancing spring 37 comprises a helically coiled tension spring extending longitudinally within the hollow arm 34 and anchored to the arm at its upper end as by means of an adjustment screw 48 (FIGS. 6 and 10) which has threads 49 complementary to the helical coils of the spring 37 and screwed into the upper end portion of the spring. A head 50 with a screwdriver kerf on the upper end of the screw 48 bears against a thrust surface provided by a rearwardly extending upwardly facing crown flange 51 projecting from the upper end of the front wall 44 and supportingly engaged upon inturned shoulder and reinforcing flanges 52 on the upper ends of the side walls 45. A clearance hole 53 in the thrust 51 clears the shank of the screw 48. By manipulating screw head 50 with a screwdriver applied to the kerf in the top thereof, tensioning of the spring 37 is easily effected. Unintentional, heat or vibration induced, turning of the screw 48 out of adjustment is avoided by means of an upwardly extending detent shoulder 51*a* formed on the flange 51 to underlie the screw head 50 and engage in a selected one of a series of generally radially extending circumferentially spaced detent socket indentations or grooves 50*a* in the thrust face surface of the head 50. By having at least the grooves 50*a* provided with sloping cam sides adjustment turning of the screw 50 with the aid of a screwdriver is easily effected by torquing the head over the detent 51*a*.

Coupling of the spring 37 to the mechanism 38 is effected by engagement of a lower end upwardly opening anchoring hook 54 on the spring under and about a crossbar 55 (FIGS. 6–8) on the upper end of a vertically elongated coupling member 57 which is of complementary width to the space between the side walls 45 for vertical sliding movement therebetween and along inturned reinforcing and bearing flanges 58 (FIG. 9) on the lower portions of the rear edges of the side walls 45. The confronting edges of the flanges 58 are sufficiently spaced to clear the bracket arm 43. Stop lugs 59 lanced in and bent from the flanges 58 extend into a longitudinal clearance 60 in the adjacent face of the member 57 providing shoulders 61 at the opposite ends of the clearance, and with the upper of which shoulders 61 the lugs engage to stop the hinge assembly in the fully open door position (FIG. 8).

On its lower end portion, the coupling member 57 has a vertical slot 62 to clear the bracket arm 43 and is provided with a vertical series of rack teeth 63 facing inwardly at each side of the slot 62 and meshing with complementary teeth 64 provided on a suitable chordal portion of a pair of preferably identical spur gear members 65 fixed nonrotatably to the respective opposite sides of the bracket arm 43. For this purpose, the bracket arm 43 is formed with a hole 67 about the area through which the pivot pin 35 extends, the hole having respective oppositely extending geometric enlargements 68 receptive of respective complementary angular anchoring bosses 69 (FIGS. 5, 6 and 7) on the adjacent sides of the gear members 65 and providing with aligned bearing holes 70 in the gear members supporting bearing means journaling the pivot pin 35. For smooth, quiet operation, the coupling member 57 and the gear members 65 may be made from a suitable material such as nylon, although if preferred these parts may be molded from sintered metal.

For convenience in mounting the door 21 on the hinge assemblies 20, respective tubular sockets 71 complementary to and receptive of the hinge arms 34 are secured to the inside of the lower portion of the door liner 27 and suitably aligned with one of the openings 31 in the lower edge 30 of the door. In a preferred construction, the socket 71 comprises a tubular hollow metal formed up from sheet metal into a vertically elongated generally channel shaped configuration having lateral attachment flanges 72 by which the socket member is fastened as by spot welding to the door liner 27. At its lower end the socket member 71 is flared as shown at 73 to facilitate sliding reception of the arm 34 by a downward movement of the door relative to the arm 34. Suitably adjusted level position of the door on the hinge arm 34 is assured by means of adjustable stop screws 74 which with respect to each of the arms 34 is threaded into a tapped eye 75 in the crown flange 51. Lapped over crown flanges 77 on the upper end of the socket member 71 provide a thrust bearing stop engaged against the upper end of the adjustable screw 74. A suitable slot 27*b* in the lower portion of the door liner 27 clears the bracket 43.

Means are provided for holding the arm 34 in a partially open position as shown in FIG. 7, which in a domestic or commercial range is the broil position. Such means comprise a leaf spring detent arm 78 fastened to an anchorage device 79 on the arm wall 44 and depending therefrom to a rearwardly and downwardly angled oblique detent finger 80 reinforced by generally returned bent terminal flange 81 and normally biased to thrust toward and into engagement with the longitudinally slidable spring coupling member 57. To forestall an undesirable reverse deflection of the spring detent 78, lanced inwardly bent retainer flanges 82 may be provided on the side walls 45 of the arm 34. In the closed door position of the arm 34 the detent finger 80 underlies a generally inwardly projecting detent cam shoulder 83 and affords resistance to inadvertent opening of the door by resisting movement of the detent shoulder projection 83 past the biased finger 80. Manually applied door opening leverage applicable through the door 21 causes the arm 34 to swing toward open position. Since the spur gear member 65 through the rack portion of the coupling member 57 anchors the member 57 against longitudinal displacement relative to the bracket 43 but permits swinging movement of the member 57 with the arm 34, while the detent arm 78 anchored fixedly to the arm 44 displaces generally longitudinally away from the bracket 43 during the open swinging movement, the detent finger 80 is caused to snap back past the detent projection 83 toward the upper side of the projection with a slight and sensible clicking reaction noticeable by the person swinging the door open. In this relationship, the detent finger 80 acting against the detent shoulder projection 83 will hold the arm 34 against tension of the spring 37 tending to swing the door back toward the closed position. If it is desired to close the door, a simple push on the upper portion of the door will lever the hinge arm 34 to effect strain release of the detent 78 by camming of the finger 80 along the projection 83 until it snaps back onto the lower side of the projection and assists in holding the door closed in cooperation with the spring 37. Should it be desired to open the door farther from the partially open position of FIG. 7, there is complete freedom for the detent finger 80 to slide along the coupling member 57 and cooperate with the progressively tensioned spring 37 to counterbalance the door at any point intermediate the partially open position of FIG. 7 and the fully open position of FIG. 8.

An abuttment surface 65*a* provided on each of the gear members 65 engages with a complementary surface 57*a* to stop the hinge assembly in its fully open door position, in load distributing cooperation with the lugs 59 and the upper shoulder 61.

Means are provided for locking the hinge arm 34 so that it will not swing back toward closed door position beyond the partially open position of FIG. 7 when the door 21 is removed from the hinge arm. For this purpose, a latch device is provided comprising a bail-like spring member 84 (FIGS. 3, 4, and 9) having elongated arms fixedly secured by means of anchors 86 to the side walls 45 of the arm 34 and normally biased to project toward the rear side of the arm 34, as shown in phantom outline in FIG. 4, so that elbows 85 at juncture with a forwardly projecting latching yoke 87 normally tend to project rearwardly beyond the rear side of the arm so that when the arm 34 is received within the door 21, the lower portion of the door liner 27 will engage and thrust the elbows 85 forwardly whereby to hold the yoke 87 in clearance released position relative to the forward end of the bracket arm 43. Should it be desired to remove the door 21 by pulling it free from the hinge arm 34, while in the partially open position shown in FIG. 7 which is the normal position for such a maneuver, then, as the door is pulled off of the hinge arm 34, the elbows 85 of the latch spring 84 are released and spring rearwardly away from the rear of the arm 34. Thereupon, the yoke 87 moves through a horizontal slot 87*a* in the lower portion of the front wall 44 and engages behind a latch terminal shoulder 88 on the tip of the arm 43 as indicated in dash outline in FIG. 7. This positively locks the hinge arm 34 against swinging back to the closed position under the bias of the spring 37, until the door is returned and the latch spring 84 released.

Figure 11:
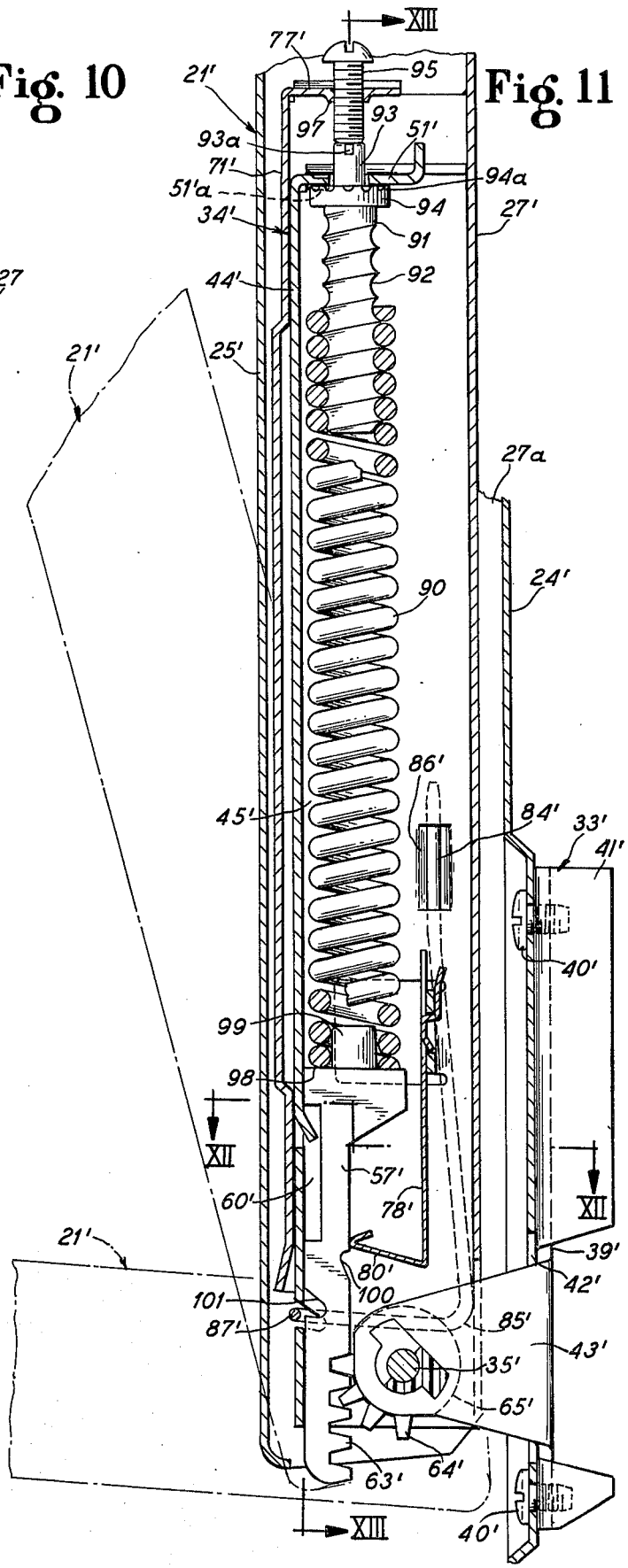
FIG. 11 is a vertical sectional detail view similar to FIG. 6, but showing a modification.
Figure 12:
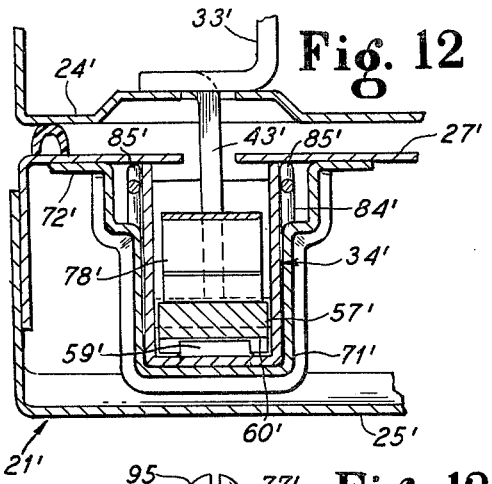
FIG. 12 is a horizontal sectional detail view taken substantially along the line XII—XII of FIG. 11.
Figure 13:
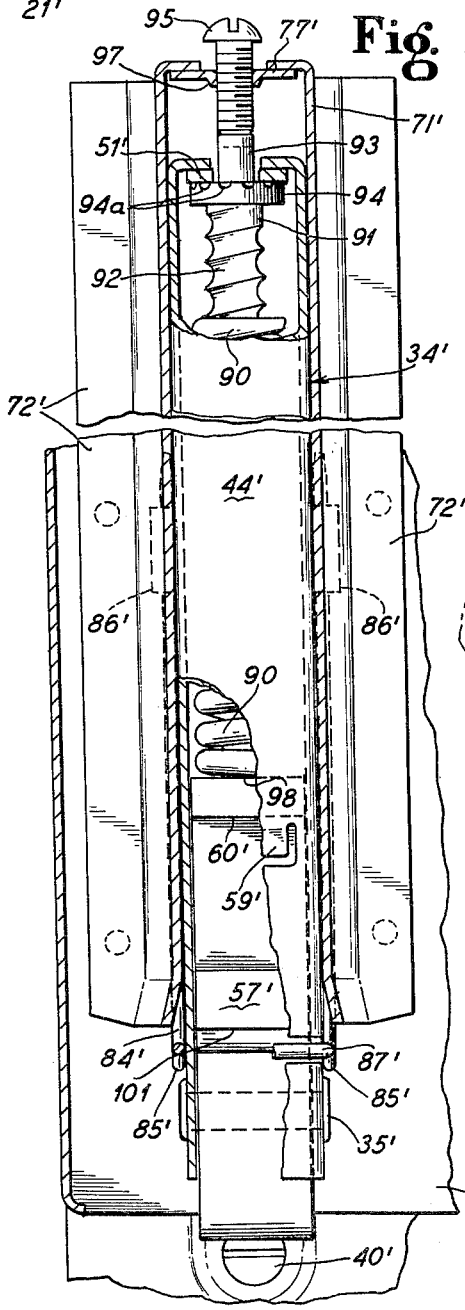
FIG. 13 is a fragmental sectional elevational detail view taken substantially along the line XIII—XIII of FIG. 11.

In FIGS. 11–13 a modified embodiment of the invention is substantially the same structurally as and functions substantially the same as the embodiment of FIGS. 2–10, except that instead of a tension type of counterbalancing spring, a compression counterbalancing spring 90 is employed. Other elements useful in the assembly are reversed as necessary to accommodate the compression spring operation. To the extent that elements of the assembly in FIGS. 11–13 are substantially the same structurally, they have been identified by primed reference numerals and for sake of brevity may not be explicitly referred to and it will be understood that the description of the corresponding element in FIGS. 1–10 will apply with equal effect and is incorporated at this point as if fully reiterated. The spring 90 is maintained under adjustable compression by means of an adjusting screw 91 provided with threads 92 complementary to the helical coils of the spring 90 so that by manipulating a head 93 by means of a screwdriver engaged in a crown kerf 93*a* to turn the screw in the appropriate direction, tenson of the spring 90 can be readily adjusted as desired. A thrust collar 94 on the head end of the screw shoulders against the flange 51' on the upper end of the arm 34'. In this instance, vertical adjustments of the sockets 71' relative to the arm 34' to effect similar adjustments of the door 21' relative to the arm 34' are effected by means of an adjusting screw 95 threaded through a tapped eye 97 in the flange 77' at the upper end socket member, and desirably thrusting at its lower tip against the adjusting screw head 93. Unintentional turning of the screw 91 out of adjustment is avoided by detent means comprising a downwardly projecting detent shoulder 51'*a* formed on the flange 51' and engageable selectively in any one of a circumferentially spaced series of upwardly opening radially extending detent socket indentations or grooves 94*a* in the upper thrust face of the head flange 94, and functioning similarly as the detent shoulder 51*a* and grooves 50*a* previously described.

At its lower end, the compression counterbalancing spring 90 thrusts against an upwardly facing shoulder 98 provided on the upper end of the reciprocatingly slidably mounted coupling member 57', an upstanding boss 99 being received in the lower end of the spring for centering purposes. In this instance, the broil or partially open position of the door 21' is selectively retained by cooperation of the detent spring arm 78' thrusting its detent finger 80' into a shoulder notch 100 in the member 57' and from which the detent finger 80' can be readily pressure responsively disengaged from moving the door 21' toward the fully open position and during which maneuver the compression spring 90 counterbalances the door.

In the broil or partially open position, should it be desired to remove the door 21', and the door is pulled from the hinge arm 34' the shoulders 85' of the yoke-equipped rearwardly biased latching spring 84' are released rearwardly so that the yoke 87' engages in a latching notch 101 in the outer face of the coupling member 57' which in this instance slides along the inner side of the front wall 44' of the arm 34'. Return of the door into its supported position on the arm 34' effects release of the latch so that the door can be operated throughout its range of movement.

Figure 15:
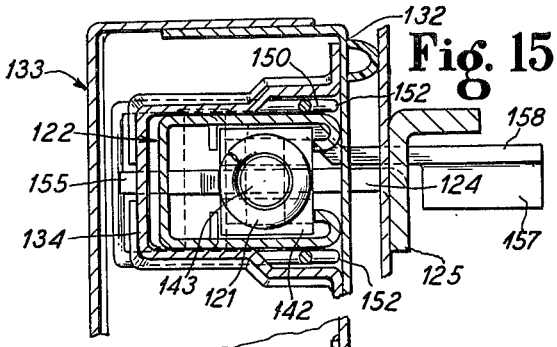
FIG. 15 is a horizontal sectional detail view taken substantially along the line XV—XV of FIG. 14.
Figure 14:
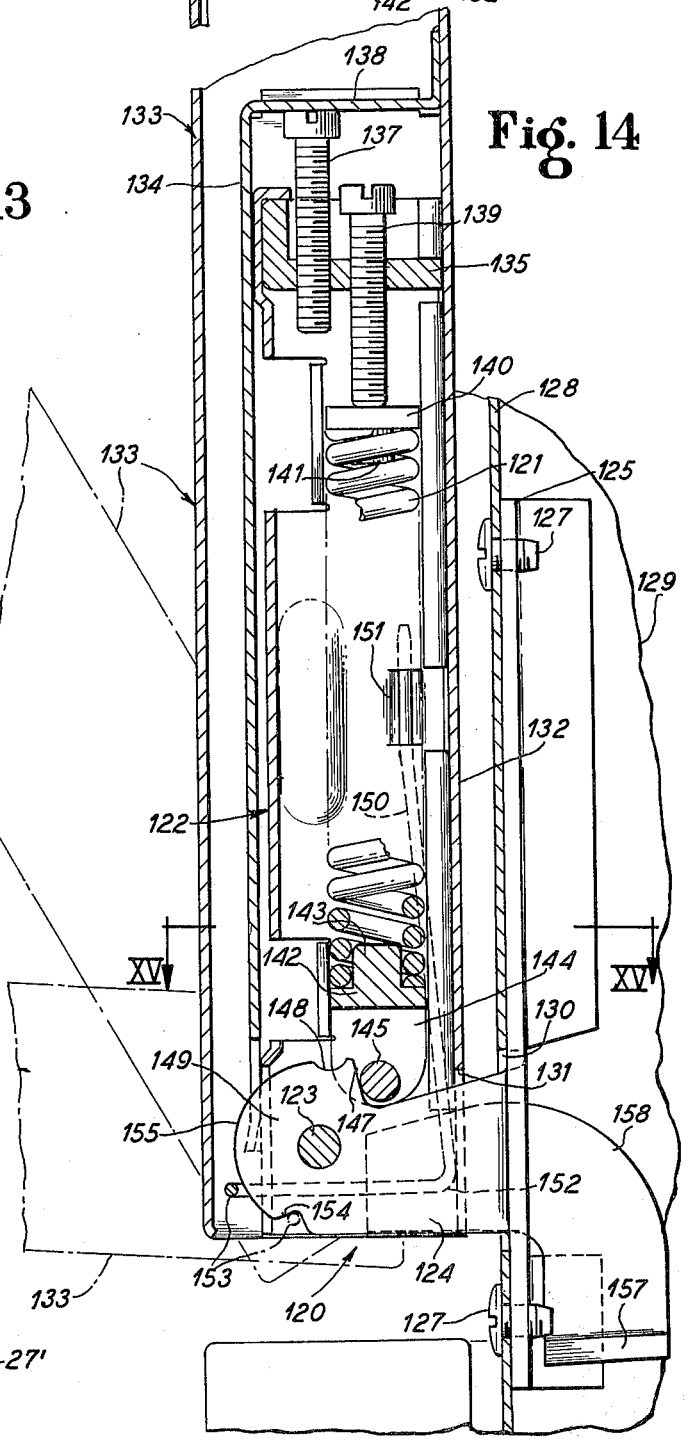
FIG. 14 is a view similar to FIG. 6, but showing another modification.

In FIGS. 14 and 15 another embodiment of the invention comprising counterbalancing hinge assembly 120, for a range oven door or the like, having an elongated helically coiled counterbalancing compression spring 121 is depicted carried within one arm 122 articulated as by means of a pivot pin 123 which hingedly connects it to an arm 124 of a bracket 125. This bracket similarly as the bracket 33 comprises an elongated body secured as by means of self-topping screws 127 to a range or other body structure casing 129. The arm 124 which is formed integrally with the bracket 125 projects in a vertical plane forwardly through a suitable slot 130 in the frame 129 and extends through a clearance slot 131 in the lower portion of a liner panel 132 of a door 133 which may be mounted on the arm 122 by means of a socket 134 suitably secured fixedly to the inner face of the liner 132 so that the door is adapted to be applied to or lifted from the arm 122 by a generally upward sliding movement of the door and socket 134 relative to the arm 122.

Similarly as in the other forms of the invention described, the arm 122 is of hollow elongated form so as to house the counterbalancing spring 121. As its upper end the arm 122 carries a removable crown piece 135 which is threaded a vertical adjustment screw 137 on the head of which a crown flange 138 on the upper end of the socket 134 rests to maintained the vertically adjusted position of the socket and thereby the door 133 relative to the hinge arm 122. In addition, the crown piece 135 carries means for adjusting the action of the spring 121 comprising an adjustment screw 139 threaded through the crown piece 135 and thrusting at its lower end against a thrust pad 140 bearing against the upper end of the spring 121 and carrying a centering boss 141 projecting down into the upper coils of the spring.

Coupling of the spring 121 with the hinge arm 124 is effected by means of a thrust member 142 engaged by the lower end of the spring and maintained centered by an upwardly projecting centering boss 143 on the thrust member. On its lower end portion, the member 142 is bifurcated by means of a slot 144 to receive the arm 124 whereby a detent shaft 145 extending across the slot 144 can engage a cam surface 147 extending obliquely upwardly and forwardly on the upper side of the arm 124. Thereby compressive force of the spring 121 acting through the detent shaft 145 serving as a follower against the cam 147 will maintain the door 133 closed until the opening leverage is applied through the door on the arm 122 to cause the detent shaft 145 to ride up along the cam surface 147 and thus compress the spring until the door open position of the door 133 is reached wherein the detent shaft 145 snaps into the detent notch 148 in the upper edge of the head 149 in the terminal end of the arm 124. This will hold the door in the broil or partially open position in a substantially strain separable condition, that is by straining against the detent either in the door closing position, or in a door opening position by levering the door 133 and thereby the arm 122, the detent shaft element 145 can be displaced from the detent notch 148.

If, while the door 133 is in the partially open position, it is desired to remove the door 133 from the hinge arm 122, upward sliding movement will effect such removal. As an inicident to such removal of the door, as it is pulled from the arm 122, a yoke latch spring 150 is activated by releasing it from an inactive position to latch the hinge arm 122 against inadvertent displacement from the partially open position. For this purpose, the latch spring 150 has two arms which are anchored at 151 to the opposite sides of the arm 122 in a biased manner such that elbows 152 at lower ends of the arms normally tend to extent into interference relation to the door panel 132 in the assembled relation of the door on the hinge arm 122 and wherein a yoke 153 is maintained in a released position relative to the hinge arm head 149. When the door is lifted off the hinge 120, the spring 150 is released and the yoke 153 activated to engage in a latching notch 154 formed in the lower edge of the head 149 as shown in broken outline in FIG. 14. Upon return of the door to the mounted position on the hinge assembly, the latching yoke 153 is released so that the door can be moved either toward the closing position or toward open position. If the door is moved toward the open position, the detent shaft element 145 rides along an arcuate surface 155 concentric with the pivot pin 123 and places the spring 121 under increased compresson for counterbalancing the door. In the fully open position of the door 133, a stop 157 comprising a flange at a free end of an arcuate stop arm 158 extending through the clearance slots 130 and 131 parallel with the arm 124 and fixedly secured to the lower end portion of the arm 122 comes to a stop against the bracket body 125 whereby to hold the door against downward displacement from the fully open position.

In the form of the invention shown in FIGS. 16–19, the general structure and operation are similar to the previously described forms of the invention, and in addition means are provided for positively locking the door against being pulled from the hinge assembly when it is opened beyond the predetermined partially open position. Accordingly, a counterbalancing hinge assembly 160 comprises an arrangement which is similar to the arrangement of FIGS. 1–10 and includes relatively articulated members comprising a supporting bracket 161 which may be substantially like the supporting bracket 33 and provided with an arm 162 which projects forwardly from a body 163 such as the body of a major appliance such as a domestic or commercial range, a dishwasher, a clothes dryer of the domestic or commercial variety, or the like. Pivotally connected to the arm 162 is an elongated arm 164 adapted to be received within a hollow downwardly opening door 165 of similar construction as the door 21 having a front panel 167 and a rear panel 168 to which is secured in a generally vertical position a tubular socket 169 having longitudinally extending lateral flanges 170 secured as by means of spot welding to the inner face of the panel 168 and opening downwardly to be slipped into position over the arm 164.

Figure 17:
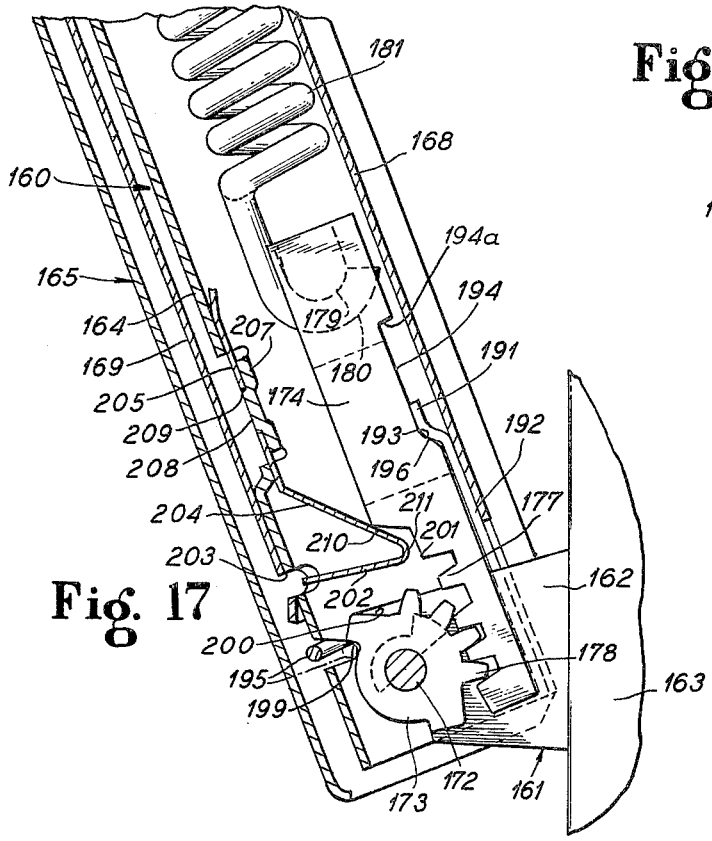
FIG. 17 is a view similar to FIG. 16, but showing the door partially open.

Lower end portions of side walls 171 of the arm 164 are pivotally connected to the bracket arm 162 by means of a shaft or pivot pin 172 which is journaled by means of complementary spur gear members 174 mounted fixedly on the arm 162 in similar fashion as the spur gear members 65 and providing part of a coupling including a rack member 174 provided with a slot 175 to straddle the bracket arm 162 and equipped with rack teeth 177 meshing with the teeth 178 on the spur gear members 173. On its upper end portion, the coupling rack member 174 has a transverse integral bar 179 with which a lower end coupling hook 180 of a coiled tension spring 181 is engaged. At its upper end portion, the spring 181 is engaged by a tensioning screw 182 which is threaded into the upper coils of the spring and has a head 183 thrusting downwardly against a rearwardly extending shoulder flange 184 on the upper end of the front wall of the hollow arm 164. Detent means comprising a raised detent shoulder 185 engageable in any selected one of a series of circumferentially spaced radially extending detent socket grooves 187 in the lower thrust face of the head 183 holds the screw 182 against unintentional torsional displacement from any adjusted spring tension position of the screw to which the screw may be turned by application of a screwdriver in a crown kerf 188 in the head 183. An adjustable stop screw 189 threaded into the flange 184 has its head in bearing stop engagement against the underside of flange structure 190 across the upper end of the socket member 169. When the door 165 is swung open, the counterbalancing spring 181 is progressively tensioned by coaction of the fixed spur gears 173 and the rack member 174 which is drawn toward the open end of the arm 164. As the angle of the opening door reaches about 20° to the vertical position, latching means come into play for holding the door in the partially open position against normal closing tension of the spring 181 up to that point. In a desirable construction, the partial door open latch comprises forwardly offset extensions 191 on the upper ends of inturned flanges 192 on the lower portions of the rear edges of the side walls 171 of the arm 164 and located in spaced relation at either side of the bracket arm 162. In the closed position of the door, as viewed in FIG. 16, the latch detent extensions 191 engage against the back of the coupling member 174, canting it slightly forwardly out of axial alignment with the top of the screw 182 the shank of which is sufficiently loosely received through the flange 184 to permit slight rocking of the screw for this purpose. Thereby the spring 181 reacts to maintain a rearward pressure on the member 174 toward the detent offset extensions 191. Hence, when the door reaches the partly open position as shown in FIG. 17, the detent extensions 191 will engage with sufficient firmness with complementary detent shoulder 193 at the lower end of a clearance recess 194 in the back of the member 174 to hold the member 174 against the tension of the spring 181 whereby to maintain the door open against the counterbalancing force of the spring, until the door is deliberately thrust toward the closed position. In order to facilitate transitional movement of the shoulder 193 and shoulders 196 and shoulders 196 on the detent offsets 191, the respective surfaces of the shoulders 193 and 196 which must pass one another are formed on fairly large radius as shown. This assures smooth relative movement of these parts in the opening and closing movements of the door.

While the door 165 is in the partially open position as shown in FIG. 17, it can be lifted from the hinge structure similarly as described in connection with the door 21. In such event, a yoke bar 195 of a yoke spring 197 anchored to the side walls 171 is released similarly as described for the spring 84 to effect movement of the latching yoke bar 195 through a clearance aperture 198 in the front lower portion of the arm 164 to engage behind a latch terminal shoulder 199 on the tip of the arm 162 and an overhang on the spur gears 173 as best seen in phantom outline in FIG. 17. This positively locks the hinge arm 164 against swinging back to the closed door position under the bias of the spring 181 and until the door is returned into supported position on the hinge arm 164 and the latch spring 197 released.

Figure 18:
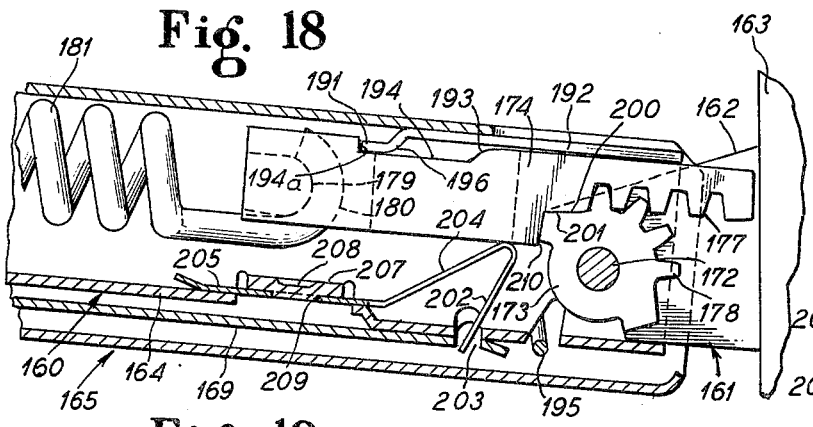
FIG. 18 shows the same door fully open.
Figure 19:
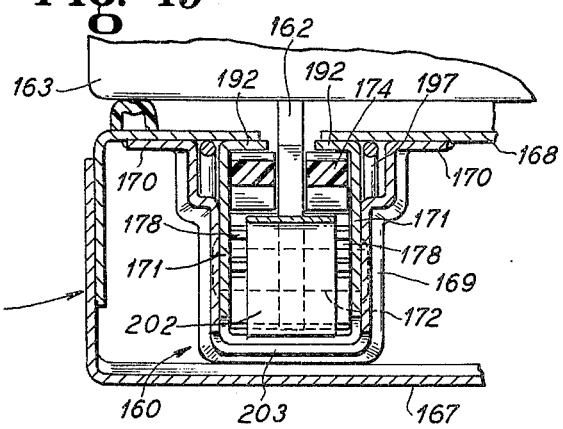
FIG. 19 is a fragmentary horizontal sectional detail view taken substantially along the line XIX—XIX of FIG. 16.

From the partially open position, the door 165 may be swung open to any desired degree to the fully open position depicted in FIG. 18. At this point stop shoulder means 200 on the gear members 173 receives stop shoulder means 201 on the member 174. At the same time the latch detent extensions 191 engage with a shoulder 194*a* at the top end of the coupling member recess 194. Also, the bottom edge open position the supporting bracket 161 engages with the inside face of the lower end of the arm 164. This provides maximum, three-point load distribution means for holding the door in fully open position.

Figure 16:
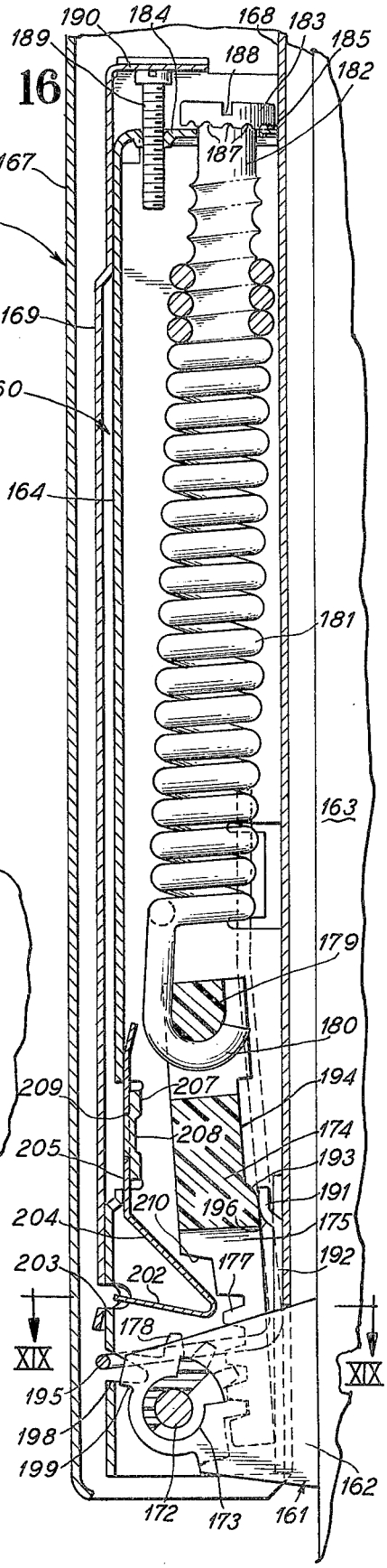
FIG. 16 is a vertical sectional elevational detail view similar to FIG. 6, but showing still another modification.

Safety means are provided for locking the door 165 against being pulled from its hinges after being swung toward the fully open position from the partially open position of FIG. 17. For this purpose, a locking finger 202 is located to be normally inactive but to be thrust through aligned apertures 203 in the arm 164 and the sleeve 169 as best seen in FIG. 18 when the door is swung open past the partially open position of FIG. 17, whereby positive interference with axial door removal shifting of the sleeve 169 is effected. In an effective structure, the safety locking finger 202 comprises a suitable terminal projection turned to extend generally forwardly from the free end of a downwardly and rearwardly oblique spring cam shoulder portion 204 of a leaf spring member 205 mounted on the inner side of the lower portion of the front wall 164 of the arm 160. In a convenient manner of mounting the vertically extending body portion of the spring member 205, a retaining strap 207 is suitably lanced and rearwardly offset in the lower end portion of the front wall 164 such that the body of the member 205 is received between the strap 207 and the portions of the wall 164 at the upper ends of the recess from which the strap 207 is lanced. Intermediately the retaining strap 207 is provided with a forwardly embossed retaining lug 208 which is engaged in a complementary aperture 209 in the member 205. Through this arrangement, the resilient cam portion 204 is supported to underlie a downwardly facing shoulder structure 210 on the coupling member 174. In the closed door position as shown in FIG. 16, the shoulder 210 is clear of the resilient cam shoulder portion 204 and the locking finger 202 is in rearward clearance relation to the apertures 203. This relationships persists to the partially open position as shown in FIG. 17, where the shoulder 210 is barely in contact with the cam shoulder 204. Then as the door is swung further open, the shoulder 210 thrusts against and resiliently deflects the cam shoulder 204 forwardly and drives the finger 202 into the locking position where it is retained by engagement with the front face of the member 174 above the shoulder 210 by a heel 211 at juncture of the finger 202 with the cam shoulder 204, until the door is swung back to the partially open position where the heel 211 releases from the front face of the member 174 and springs back uner the shoulder 210 by reason of the resilient spring bias of the shoulder cam portion 204.

From the foregoing it will be apparent that the present invention provides counterbalancing hinge assemblies for range oven doors or the like, which have smooth, quiet action, which will efficiently counterbalance any incremental position between partially open tilted position and the fully open generally or nearly horizontal position in which the counterbalancing spring is located in the cool zone within the door, the door ca be easily and safely and efficiently removed or replaced, and the counterbalancing spring is easily and efficiently adjustable to provide effective counterbalancing over a wide range of weights. By virtue of the back of the spring-carrying door supporting arm of the hinge assembly being open, the spring is readily accessible for interchanging of springs if necessary or desirable. The counterbalancing spring can be quite readily serviced in the field, and is readily adjusted for tension or compression, as the case may be, or replaced. The coupling for the spring in the hinge assembly provides an efficient and reliable part of mechanism for releasably holding the door in partially open position. There is a highly efficient latching device for holding the door mounting hinge arms in the partially open position during door removal. Positive safety lock means are provided against pulling the door from the hinges except in preselected partially open position. The hinge structure is adapted for use with a wide range of appliance doors. Servicing of the counterbalancing hinge mechanism is easily effected from the front of a range or other body structure and does not require dismantling the hinge assembly from the range or body structure for this purpose.

It will be understood that variations and modifications may be effected without departing from the spirit and scope of the novel concepts of this invention.

I claim as my invention:

1. A counterbalancing hinge assembly adapted to mount a door in closing relation to an opening in the body structure of an appliance and from which the door must be capable of swinging to an open position about an axis along the bottom edge of the opening, comprising:

articulated members including a supporting bracket adapted to be secured to the body structure adjacent to one side of the bottom edge of the body structure opening and a generally upwardly extending elongate hollow frame arm adapted to be slidably removably received within a downwardly opening fixed socket in the door by longitudinal relative assembly of the hollow frame arm in the socket;

said bracket a body portion for fixed attachment to said appliance body structure and an arm portion projecting from said bracket body portion into the lower end of said hollow frame arm;

means pivotally connecting said lower end of the hollow frame arm to the bracket arm portion for supporting the arm and door on said bracket arm portion and for swinging of the hollow frame arm between a generally upright closed door position and a generally horizontal open door position;

an elongate counterbalancing spring within said hollow frame arm and having an upper end connected to the upper end of the hollow frame arm;

and mechanism which remains wholly within said hollow frame arm in all positions of the hollow frame arm and functions to connect the lower end of said spring to said bracket arm portion within said hollow frame arm;

said mechanism being operative in the upright position of the hollow frame arm to cause the spring to bias the hollow frame arm toward the closed door position;

said mechanism also being operative to cause the spring to counterbalance the door throughout the range of movement of the hollow frame arm and the door between a partially open door position and a fully open door position.

2. A hinge assembly according to claim 1, including socket means adapted to be fixedly mounted within the door to provide said socket to receive said hollow frame arm, and means at the top of the socket means and the top of the hollow frame arm for adjusting the longitudinal position of the socket means and the hollow frame arm relative to each other.

3. A hinge assembly according to claim 1, including detent means on said hollow frame arm and on said mechanism for maintaining the hollow frame arm in a partially open door tilted position, and a latching device carried by said hollow frame arm operable to engage a shoulder on said bracket arm portion in the absence of a door on said hollow frame arm to lock the hollow frame arm in said partially open door position.

4. A hinge assembly according to claim 1, wherein said counterbalancing spring is a helically coiled tension spring having a lower end hook, and said mechanism includes a yoke engaged by said hook.

5. A hinge assembly according to claim 1, wherein said counterbalancing spring is a helically coiled compression spring.

6. A hinge assembly according to claim 1, wherein said connecting mechanism comprises a rack and pinion assembly 7. A hinge assembly according to claim 6, wherein said rack and pinion assembly comprises a longitudinally slidable rack member connected to the spring and stationary pinion means carried by said bracket arm portion within the hollow frame arm and meshing with the rack member.

8. A hinge assembly according to claim 7, including detent means carried in part by the rack member and in part by the hollow frame arm for holding the hollow frame arm in a partially open door position.

9. A hinge assembly according to claim 1, wherein said hollow frame arm and said counterbalancing spring include means for adjusting the action of the spring.

10. A hinge assembly according to claim 9, wherein said hollow frame arm includes means for adjusting the longitudinal position of the hollow frame arm in the socket and thereby the position of the door of the hollow frame arm.

11. A hinge assembly according to claim 9, including means defining said socket in the door, and means carried by the socket means cooperating with said means for adjusting the action of the spring, for effecting adjustments in the longitudinal position of the hollow frame arm in the socket and thereby of the door relative to the hollow frame arm.

12. A hinge assembly according to claim 1, including means defining said socket, interlock shoulder means on said socket means, a locking device comprising a spring element having a finer projecting toward said interlock shouler means and normally biased away from said shoulder means, and said mechanism including a member having means for actuating the spring element to drive the finger into coacting relation with the shoulder means for precluding removal of the door from said hollow frame arm when the door is swung from a preselected partially open position toward fully open position.

13. A hinge assembly according to claim 1, wherein said counterbalancing spring comprises a compression spring, said mechanism comprise a thrust member under spring compression thrust toward said bracket arm portion, and means on portion bracket cooperating with said thrust member.

14. A hinge assembly according to claim 1, wherein a latching device comprising a yoke spring having a pair of spaced arms is fixed to said hollow frame arm and has elbows located to be engaged by the door to inactivate the latching device, and a yoke bar connecting the spaced arms beyond the elbows is engageable in latching relation with said bracket arm portion when the door is removed from the hollow frame arm.

15. A hinge assembly according to claim 1, including a latching device which comprises a yoke spring having a pair of spaced arms fixed to said hollow frame arm and elbows located to be engaged by the door to inactivate the latching device, said yoke spring having a yoke bar connecting the spaced arms beyond said elbows and engageable with a pair of said mechanism when the yoke spring is activated in the absence of a door on the hollow frame arm.

16. A hinge assembly according to claim 1, including stop means in the assembly providing a plurality of door load distribution stop points operative for stopping the hinge assembly in a fully open door position.

17. A hinge assembly according to claim 1, wherein said counterbalancing spring is a compression spring, an opening at the top of said hollow frame arm, a top member removably closing said top opening, a thrust screw threaded through said top member and thrusting against the upper end of said spring, and an adjustment screw threadedly engaged in said top member and projecting thereabove and engageable with a shoulder on means providing said socket for adjusting the level of the door within which the socket means are mounted.

18. A hinge assembly according to claim 1, wherein said hollow arm has an upper end abutment structure, a screw adjustably engaging the upper end of the spring and having a head in engagement with said abutment structure, and cooperating detent means on the screw head and said abutment structure for releasably holding the screw against turning from an adjusted position.

19. A counterbalancing hinge assembly according to claim 1, wherein said hollow frame arm has an opening through which said spring is adapted to be installed and through which the spring is accessible for removal and replacement when the hollow frame arm is separated from said socket.

20. A counterbalancing hinge assembly according to claim 1, wherein said mechanism comprises a generally arcuate member carried rigidly by said bracket arm portion on a short radius about said pivot and a member connected to the lower end of the spring and operatively tansmitting spring force to said arcuate member progressively along its arc in movement of the hollow frame arm to and from the open door position whereby to effect smooth, substantially constant counterbalancing of the door.

21. A counterbalancing hinge assembly according to claim 20, wherein said arcuate member comprises a segmental gear structure providing a half pitch diameter, and said member connected to the lower end of the spring comprises a rack meshing with said gear structure.

22. A counterbalancing hinge assembly according to claim 20, wherein said arcuate structure comprises an arcuate surface on a head on said bracket arm portion, and said member connected to the spring comprises a thrust member for engagement with said arcuate surface, said spring being a compression spring thrusting said thrust member toward said arcuate surface.

23. A counterbalancing hinge assembly according to claim 22, wherein said head has a cam engageable by said thrust member to effect spring bias of the hollow frame arm into closed door position, and said head also has a detent recess in which the thrust member is engageable to retain the hollow frame arm releasably in partially open door position.

24. A hinge assembly according to claim 1, wherein said mechanism comprises a spur gear assembly mounted on said bracket arm portion, means connecting the gear assembly and the bracket arm portion fixedly whereby to hold the gear assembly against rotation relative to the bracket arm portion, and said connecting means comprising a shaft extending through said gear assembly and connected to the lower end of the hollow frame arm.

25. A hinge assembly according to claim 1, including, in combination, means defining a downwardly opening socket adapted to be mounted fixedly within the door and receptive of said hollow frame arm by relative longitudinal sliding movement, at least the upper and lower end portions of said hollow frame arm and said socket defining means having close tolerance sliding fit engagement for holding the hollow frame arm firmly against looseness in the assembled relation of the hollow frame arm within the socket.

26. A door counterbalancing hinge assembly adapted to support a door on a body structure in closing relation to an opening in the body structure and from which the door must be capable of swinging to an open position about an axis along the bottom edge of the opening, comprising:

articulted hinge members one member of which is adapted to support the door and the other member of which is adapted to be secured fixedly to the body structure;

means pivotally connecting the members for movement between a closed door position and an open door position;

counterbalancing spring means carried by and operatively connected to said one member;

means operatively connecting the spring means to said other member and comprising a reciprocatable part;

and separable detent means comprising a part located in a fixed position on said one member and coactive with said reciprocatable part to maintain the members selectively in a partially open door position and being separable by movement of said reciprocatable part in response to leverage force applied to said one member toward either the closed door position or the open door position from said partially open door position.

27. A hinge assembly according to claim 26, wherein said fixed location part comprises a resilient detent finger carried by said one member, and said connecting means part comprises a member connected to the counterbalancing spring and having a shoulder cooperatively related to said detent finger.

28. A hinge assembly according to claim 26, in combination with a door carried by said one member, means permitting the door to be removed from said one member in said partially door open position, means comprising a spring finger carried by said one member and interlock shoulder means rigid with the door for locking the door against removal from said one member when the door is moved farther toward open position from said partially open position, and said connecting means having a part operative in the movement of the door farther toward open position from said partially open position to thrust said finger into interlocking relation to said shoulder means to thereby lock the door against removal.

29. A counterbalancing hinge assembly adapted to mount a door in closing relation to an opening in the body structure of an appliance and from which the door must be capable of swinging to an open position about an axis along the bottom edge of the opening, comprising:

articulated members including a supporting bracket adapted to be secured to the body structure adjacent to one side of the bottom edge of the opening and an arm adapted to be received within the door;

means pivotally connecting the arm to the bracket for swinging of the arm between a generally upright closed door position and a generally horizontal open door position;

an elongate counterbalancing spring carried by said arm and operative in the upright position of the arm to effect spring bias of the arm toward the closed door position, and operative to counterbalance the door when the arm is moved with the door between said upright position and said open door position;

said spring having one end connected to the arm;

rack means connected to the opposite end of the spring;

spur gear means fixedly mounted on said supporting bracket and meshing with said rack means so that when the arm is swung pivotaly on pivotally bracket, coaction of the spur gear means with the rack means causes the rack means to more relative to the arm and condition the counterbalancing spring for its counterbalancing function;

and said spur gear means and the rack means having cooperative stop surfaces which engage when the arm is moved to the fully open door position relative to the supporting bracket.

30. A counterbalancing hinge assembly according to claim 29, including means defining an elongate socket and adapted to be mounted fixedly within the lower portion of the door and having a downwardly directed mouth opening for access from the lower edge of the door, said arm being received within said socket through said mouth opening, a latch member carried by said arm and having means maintaining the latch inactive while the arm is within said socket, and said spur gear means having a shoulder engageable by the latch when the latch is released upon withdrawal of the arm from the socket in a partial door open position, whereby to hold the arm against movement toward door closing position as biased by the counterbalancing spring.

31. A counterbalancing hinge assembly according to claim 29, including a detent element on the arm, and detent means on said rack means engageable by said detent means on the arm for holding the arm in a partially open door position in opposition to bias of the counterbalancing spring.

32. A counterbalancing hinge assembly according to claim 29, including a socket structure adapted to be mounted fixedly within the lower portion of the door and releasably receptive of said arm, and means carried by the arm and activated by said rack means when the arm is swung toward fully open position to lock the arm against withdrawal from the socket structure.

33. A counterbalancing hinge assembly according to claim 29, including stop means on said arm and on said bracket for holding the door in the fully open position in addition to said cooperative stop surfaces.

34. A door counterbalancing hinge assembly adapted to support a door on a body structure in closing relation to an opening in the body structure and from which the door must be capable of swinging to an open position about an axis along the bottom edge of the opening, comprising:

articulated hinge members, one of which comprises an elongate hollow frame arm;

means pivotally connecting the members;

an elongate counterbalancing spring extending longitudinally within said hollow arm member;

means operatively connecting one end of the spring to the other of said members;

the end of said hollow arm member opposite to the pivot having an opening through which said spring is adapted to be assembled;

a crown piece removably mounted in closing relation across said opening;

and means connecting the adjacent end of the spring to said crown piece, and permitting removal of the crown piece for access to the spring when desired.

35. A door counterbalancing hinge assembly adapted to support a door on a body structure in closing relation to an opening in the body structure and from which the door must be capable of swinging to an open position about an axis along the bottom edge of the opening, comprising:

articulated hinge members one of which is adapted to support the door and the other of which is adapted to be secured fixedly to the body structure;

means pivotally connecting the members for movement between a closed door position and an open door position;

counterbalancing spring means carried by and operatively connected to said one member;

means operatively connecting the spring means to said other member;

a door into which said one member projects for supporting the door;

means permitting the door to be removed from said one member in a partially door open position;

interlock shoulder means rigid with the door;

means comprising a spring finger carried by said one member;

and said connecting means having a part operative in the movement of the door farther toward open position from said partially open position to thrust said finger into interlocking relation to said interlock shoulder means to thereby lock the door against removal until the door is moved back to said partially open position.

* * * * *

UNITED STATES PATENT AND TRADEMARK OFFICE

CERTIFICATE OF CORRECTION

PATENT NO. : 4,021,968

DATED : May 10, 1977

INVENTOR(S) : Willard E. Kendall

It is certified that error appears in the above-identified patent and that said Letters Patent are hereby corrected as shown below:

Column 4, line 37, for "thrust 51" read --thrust flange 51--;
Column 7, line 12, for "tenson" read --tension--;
Column 10, line 37, delete "and shoulders 196";
Column 10, line 65, for "open position" read --of--;
Column 11, line 25, for "upper ends" read --upper and lower ends--;
Column 11, line 47, for "uner" read --under--;
Column 12, line 31, for "in" read --into--;
Column 12, line 33, for "bracket" read --bracket having--;
Column 13, line 34, for "door of the" read --door on the--;
Column 13, line 46, for "finer" read --finger--;
Column 13, line 47, for "shouler" read --shoulder--;
Column 13, line 59, for "portion bracket" read --said bracket arm portion--.

Signed and Sealed this

*Sixth* Day of *September 1977*

[SEAL]

*Attest:*

RUTH C. MASON
*Attesting Officer*

LUTRELLE F. PARKER
*Acting Commissioner of Patents and Trademarks*